US006511796B2

(12) United States Patent
Rocca et al.

(10) Patent No.: US 6,511,796 B2
(45) Date of Patent: Jan. 28, 2003

(54) COLOR PHOTOGRAPHIC ELEMENT

(75) Inventors: Giuseppe Rocca, Carcare (IT); Antonio Poggi, Quiliano-Valleggia (IT); Simona Fava, Genoa (IT)

(73) Assignee: Ferrania S.p.A., Savona (IT)

( * ) Notice: Subject to any disclaimer, the term of this patent is extended or adjusted under 35 U.S.C. 154(b) by 0 days.

(21) Appl. No.: 09/861,920

(22) Filed: May 21, 2001

(65) Prior Publication Data

US 2002/0015923 A1 Feb. 7, 2002

(30) Foreign Application Priority Data

Jun. 21, 2000 (IT) ..... SV2000A26

(51) Int. Cl.[7] ..... G03C 1/46

(52) U.S. Cl. ..... 430/506; 430/567; 430/543; 430/553; 430/955; 430/505

(58) Field of Search ..... 430/506, 567, 430/543, 553, 955, 505

(56) References Cited

U.S. PATENT DOCUMENTS

| | | | | | |
|---|---|---|---|---|---|
| 4,477,564 | A | | 10/1984 | Cellone et al. | 430/567 |
| 4,614,711 | A | | 9/1986 | Sugimoto et al. | 430/567 |
| 4,668,614 | A | | 5/1987 | Takada et al. | 430/567 |
| 4,728,602 | A | | 3/1988 | Shibahara et al. | 430/567 |
| 4,842,994 | A | * | 6/1989 | Sakanoue et al. | 430/543 |
| 4,865,959 | A | | 9/1989 | Sakanoue et al. | 430/548 |
| 5,482,826 | A | | 1/1996 | Okamura et al. | 430/569 |
| 5,500,330 | A | | 3/1996 | Szajewski et al. | 430/393 |
| 5,565,314 | A | | 10/1996 | Nakatsu et al. | 430/567 |
| 5,780,216 | A | | 7/1998 | Ihama | 430/567 |
| 5,821,042 | A | * | 10/1998 | Massirio et al. | 430/510 |
| 6,043,011 | A | * | 3/2000 | Cogliolo et al. | 430/506 |

FOREIGN PATENT DOCUMENTS

| | | |
|---|---|---|
| EP | 63070239 | 3/1988 |
| EP | 0 309 119 A2 | 9/1988 |
| EP | 63301950 | 12/1988 |
| EP | 0 301 477 B1 | 4/1991 |
| EP | 0 202 784 B1 | 9/1991 |
| EP | 0 299 719 B1 | 2/1993 |
| EP | 0 193 389 B2 | 3/1995 |
| EP | 0 567 083 B1 | 9/1999 |
| EP | 0 562 476 B1 | 10/2000 |
| EP | 1 055 964 A1 | 11/2000 |

* cited by examiner

*Primary Examiner*—Geraldine Letscher
(74) *Attorney, Agent, or Firm*—Mark A. Litman & Assoc. P.A.

(57) ABSTRACT

The invention provides a multilayer silver halide color photographic element comprising a support having coated thereon at least two red-sensitive silver halide emulsion layers having different sensitivity to red light, characterized in that the most sensitive of said red-sensitive silver halide emulsion layers comprises a core-shell silver bromoiodide tabular emulsion having a pure bromide core, a total silver iodide content lower than 10% and an aspect ratio higher than 4.0 and a Speed Enhancing (SE) cyan coupler represented by one of the following general formulas:

wherein A represents $(TIME)_n$—S—$R_1$—$R_2$, TIME being a timing group releasing S—$R_1$—$R_2$ with delay under developing conditions; n represents 0 or 1; $R_1$ is a divalent linking group and $R_2$ represents a water-solubilizing group or —$NR_3$—$R_4$, wherein $R_3$ and $R_4$, which may be the same or different, each represents a hydrogen atom or an aliphatic group having from 1 to 3 carbon atoms; $R_5$ and $R_9$ represent a non-diffusible ballasting group, $R_6$ represents a group capable of substituting a hydrogen atom of the naphthol ring, m represents 0 to 3, $R_7$ represents hydrogen or a halogen atom, $R_8$ represents an alkyl group, and R10 represents an aryl group.

The invention provides enhanced sensitometric properties, such as reduced formation of fog, increased speed and increased sensitivity.

6 Claims, No Drawings

COLOR PHOTOGRAPHIC ELEMENT

BACKGROUND OF THE INVENTION

1. Field of the Invention

The present invention relates to a multilayer silver halide color photographic element comprising a support having coated thereon at least two red-sensitive silver halide emulsion layers having different sensitivity to red light, characterized in that the most sensitive of the red-sensitive silver halide emulsion layers comprises a core-shell silver bromoiodide tabular emulsion having a pure bromide core, a total silver iodide content lower than 10% and an aspect ratio higher than 4.0 and a SE (Speed Enhancing) cyan coupler to improve sensitometric properties.

2. Background of the Art

There have been more strict requirements in sensitometric quality for silver halide emulsions for photographic use, which has increased demand for high level photographic characteristics such as, for example, high speed, excellent graininess, high sharpness, low fog, wider exposure latitude range and on the like.

The above mentioned requirements have been satisfied by well-known silver bromoiodide grain emulsions having a high silver iodide content in the inner part of the grains and a specific core-shell structure in the grains thereof. It is well known in the photographic art that light absorbing increases in the order of silver chloride, silver bromide and silver iodide, but development activity correspondingly decreases in the same order. By using the above described core-shell silver bromoiodide emulsions, a good balance between light sensitivity and development activity has been obtained.

Examples of core-shell silver bromoiodide emulsion are described in many patent and literature references. For example, US 4,668,614 and U.S. Pat. No. 4,728,602 describe a monodispersed core-shell silver bromoiodide emulsion having a core part comprising a silver iodide content of 10 to 45 mol % and a shell part comprising a silver iodide content lower than 5 mol %, with an average silver iodide content higher than 7 mol %. When examined by X-ray diffractometry, two peaks are evident. The first peak corresponds to the high iodide core part, and the second peak corresponds to the low iodide shell part. According to the claimed invention it is preferred to have a ratio between the diffraction intensity of the two peaks in the range of from 1/10 to 3/1, and more preferably 1/3 to 3/1.

Similarly, European Application EP 299,719 discloses a core-shell silver halide emulsion having a core comprising not less than 10 mol % of silver iodide, at least one shell consisting of silver bromide or silver bromoiodide, the outermost of which has a silver iodide content not higher than 5 mol %, and an average silver iodide content of not less than 10 mol %.

EP 309,119 discloses a core-shell silver halide emulsion having at least three silver bromide or silver bromoiodide phases of different composition. According to a preferred embodiment of the claimed emulsion, the innermost phase has a silver iodide content of at least 10 mol %, the outermost phase has a silver iodide content of not more than 6 mol %, and the intermediate phase has a silver iodide content difference with the outermost or innermost phase of at least 3 mol %. When examined by X-ray diffraction, the claimed emulsion shows three or more diffraction peaks, each corresponding to a phase containing a different percentage of iodide.

EP 202,784 describes a core-shell type silver halide emulsion having an inner core essentially consisting of silver bromide or silver bromoiodide and a plurality of shells. The outermost shell has a silver iodide content ranging from 0 to 10 mol %, the innermost shell has a silver iodide content at least 6 mol % higher than that of the outermost shell, and an intermediate shell has a silver iodide content is at least 3 mol % lower than that of the innermost shell and at least 3 mol % higher than that of the outermost shell.

U.S. Pat. No. 4,477,564 describes a multiphase bromoiodide emulsion having an average silver iodide content higher than 12%.

U.S. Pat. No. 4,614,711 describes silver bromoiodide grains with a core shell structure with a core of silver bromide or bromiodide and a first layer composed of silver bromoiodide, exterior to said core and containing more iodide than said core by 10 mol % or more.

U.S. Pat. No. 5,780,216 discloses a color negative silver halide photographic material with a core shell emulsion having a plurality of shells comprising an inner core consisting essentialy of silver bromide or bromoiodide and a plurality of shells of silver bromide or silver bromoiodide comprising a high iodide shell interposed between two shells consisting essentially of silver bromide.

EP 1,055,964 discloses a light-sensitive emulsion comprising silver bromoiodide grains of a core shell structure comprising an inner core consisting essentially of silver bromide or silver bromoiodide and a plurality of shells consisting essentially of silver bromide or silver bromoiodide. In this patent application, there is no mention about the presence of Speed Enhancing (SE) cyan couplers in the most red-sensitive emulsion layer.

Couplers having a general formula similar to that of the SE cyan coouplers of the present invention have been described, for example, in U.S. Pat. No. 4,865,959, in EP Pat. Appl. Nos. 89,843, 117,511, 118,087, 193,389, and 301,477.

European Patent No. 193,389 discloses the use of compounds capable of releasing solubilized aliphatic and aromatic mercaptans as bleach accelerator releasing compounds. The use of said compounds in triple-coat structures is not specifically described therein.

U.S. Pat. No. 5,500,330 describes a photographic element comprising at least three light sensitive silver halide layers spectrally sensitized to the same region of the electromagnetic spectrum, wherein the least sensitive such layer, or a nonsensitive layer adjacent thereto, comprises a compound which contains a releasable thiol fragment or a precursor thereof.

European Patent No. 456,181 describes the use of bleach accelerator releasing couplers in multilayered color films employing triple-coated records. This usage is said to provide improved bleaching. The examples specifically disclosed in this publication illustrate the localization of the bleach accelerator releasing couplers in the most light sensitive layers of the triple-coated records or the indiscriminate addition of them into many layers of the film. Compounds capable of releasing solubilized aliphatic or solubilized aromatic mercaptans as a bleach accelerator are described.

European Patent No. 310,125 describes a silver halide color photographic material comprising at least one silver halide emulsion containing silver iodide. The average iodide content of the emulsion is at least 7 mol % and comprises at least one compound capable of releasing a bleach accelerating agent upon a reaction with an oxidation product of an aromatic primary amine type color developing agent. This compound can be added either in the low sensitive or in the most sensitive red-sensitve emulsion layer. This silver halide emulsion containing silver iodide is preferably a core-shell emulsion having a concentration of silver iodide in the core portion that is higher than that in the shell portion. The silver halide color photographic material has excellent desilvering property and good graininess.

Japanese Kokai 02/113,242 also discloses the use of bleach accelerating releasing couplers in triple-coated red or green light sensitive color records and specifically recommends localizing the bleach accelerating releasing couplers in the most light sensitive layers of a red or green color record so as to provide improved bleaching characteristics. Compounds capable of releasing solubilized aliphatic or solubilized aromatic mercaptans as bleach accelerator are described.

U.S. Pat. No. 4,865,959 discloses triple-coated red light sensitive color records. It teaches that bleaching and color reproduction can be improved by selecting a specific and narrow sub-class of cyan dye-forming image couplers and by simultaneously incorporating bleach accelerating releasing couplers in the most light sensitive layer of the triple-coat structure. Compounds capable of releasing solubilized aliphatic or solubilized aromatic mercaptans as bleach accelerator are described.

None of the above mentione prior art reference discloses or suggests the specific combination of the present invention for increasing the sensitometric characteristics of a color photographic material.

SUMMARY OF THE INVENTION

The invention provides a multilayer silver halide color photographic element comprising a support having coated thereon at least two red-sensitive silver halide emulsion layers having different sensitivity to red light, characterized in that the most sensitive of said red-sensitive silver halide emulsion layers comprises a core-shell silver bromoiodide tabular emulsion having a pure silver bromide core, a total silver iodide content lower than 10% and an aspect ratio higher than 4.0 and a Speed Enhancing (SE) cyan coupler represented by one of the following general formulas:

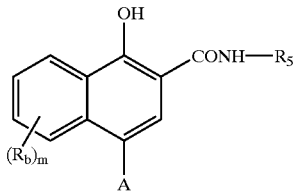

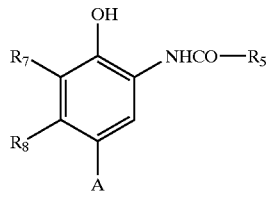

-continued

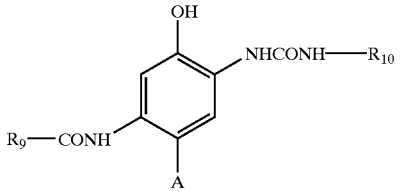

wherein A represents $(TIME)_n$—S—$R_1$—$R_2$, TIME being a timing group releasing S—$R_1$—$R_2$ with delay under developing conditions; n represents 0 or 1; $R_1$ is a divalent linking group and $R_2$ represents a water-solubilizing group or —$NR_3$—$R_4$, wherein $R_3$ and $R_4$, which may be the same or different, each represents a hydrogen atom or an aliphatic group having from 1 to 3 carbon atoms; $R_5$ and $R_9$ represent a non-diffusible ballasting group, $R_6$ represents a group capable of substituting a hydrogen atom of the naphthol ring, m represents 0 to 3, $R_7$ represents hydrogen or a halogen atom, $R_8$ represents an alkyl group, and R10 represents an aryl group.

The invention provides enhanced sensitometric properties, such as reduced formation of fog, increased speed and increased sensitivity.

DETAILED DESCRIPTION OF THE INVENTION

In previous formulas, $R_1$ is a divalent linking group, such as an alkylene group, especially a branched or straight chain alkylene group, containing 1 to 8 carbon atoms, or a heterocyclic group; $R_2$ represents a water-solubilizing group, such as a carboxy group, a sulfo group, a hydroxy group or —$NR_3$—$R_4$, wherein $R_3$ and $R_4$, which may be the same or different, each represents a hydrogen atom or a substituted or unsubstituted aliphatic group having from 1 to 3 carbon atoms. $R_5$ and $R_9$ include as a non-diffusible group (that is, a group which reduces the diffusibility of the molecule) a ballasting ("Ball") group selected so that the total number of carbon atoms is from 8 to 32; $R_6$ represents a group capable of substituting (replacing) a hydrogen atom of the naphthol ring; m represents 0 or an integer of from 1 to 3. $R_7$ represents hydrogen or a halogen atom, e.g., chlorine or bromine; $R_8$ is an alkyl group, e.g., methyl, ethyl, butyl, dodecyl, cyclohexyl and $R_{10}$ is an aryl group, preferably a phenyl group, more preferably a phenyl group having at least one substituent selected from the class consisting of trifluoromethyl, cyano, —COR', —COOR', —$SO_2$R', —$SO_2$R', —CONR'R", —$SO_2$NR'R", —OR', and —OCOR', wherein R' is an aliphatic group or an aromatic group and R" is hydrogen, an aliphatic group or an aromatic group.

Examples of $R_6$ include halogen, hydroxy, amino, carboxyl, sulfo, cyano, aromatic group, heterocyclic group, carbonamido, sulfonamido, carbamoyl, sulfamoyl, ureido, acyl, acyloxy, and the like. When $R_6$ is a group capable of substituting for the hydrogen atom of the naphthol ring in position 5 relative to the hydroxy group, suitable groups for $R_6$ are those described in U.S. Pat. No. 4,690,998, incorporated herein by reference.

Examples of $R_{10}$ include 4-cyanophenyl, 2-cyanophenyl, 3-chloro-4-cyanophenyl, 4 butylsulfophenyl, 4-ethoxycarbonylphenyl and 4-N,N-diethylsulfamoylphenyl.

TIME is a timing group joining the coupler residue to the S—$R_1$—$R_2$ group, which is released together to the S—$R_1$—$R_2$ group on coupling reaction with the oxidation product of a color developing agent and which, in turn, releases the S—$R_1$—$R_2$ group with delay under development conditions. The term "coupler residue" is herein defined as the residue of a color photographic coupler formed by the removal of a splitting off group from the coupler at the coupling position. The term "development conditions" means any processing conditions used in the art for the development of a silver halide color photographic element to form a color photographic image, such as, for example, the C41 process as described in British Journal of Photography, Jul. 12, 1974, pp. 597–598. Examples of timing groups represented by TIME include, for example, the following groups:

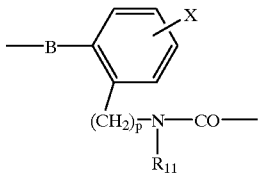

wherein B is oxygen or sulfur and is attached to the coupler moiety, p is 0 or 1, $R_{11}$ is hydrogen or an alkyl of 1 to 4 carbon atoms or an aryl of 6 to 10 carbon atoms, X is hydrogen, halogen, cyano, nitro, alkyl of 1 to 20 carbon atoms, alkoxy, alkoxycarbonyl, acylamino, aminocarbonyl, etc., as described in U.S. Pat. No. 4,248,962,

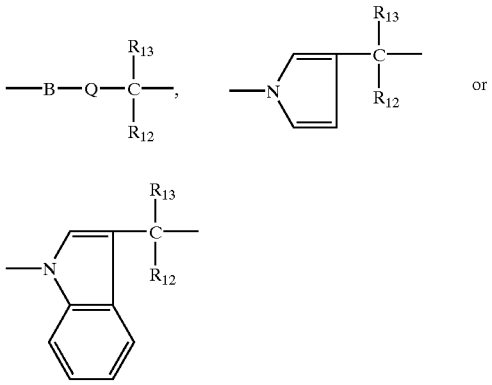

wherein the left hand side is attached to coupler moiety, B is oxygen or sulfur or

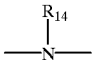

$R_{12}$, $R_{13}$ and $R_{14}$ are individually hydrogen, alkyl or aryl groups, and Q is a 1,2- or 1,4-phenylene or naphthylene group, as described in U.S. Pat. No. 4,409,323.

In the above formula, the ballasting group is an organic group of such size and configuration as to render a group to which is attached non-diffusible from the layer in which is coated in a photographic element. Said ballasting group includes, for example, an organic hydrophobic residue having 8 to 32 carbon atoms bonded to the coupler either directly or through a divalent linking group such as, for example, an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 4,138,258, and 4,451,559, and in GB 1,494,777.

When the term "group", is used in this invention to describe a chemical compound or substituent, the described chemical material includes the basic group, ring or residue and that group, ring or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen cyano, hydroxyl, nitro, amino, carboxylate, etc. On the other hand, "alkyl moiety" includes only methyl, ethyl, stearyl, cyclohexyl, etc.

Specific examples of SE cyan coupler useful in this invention are illustrated below but, but the invention is not limited to these specific compounds.

(I-1)

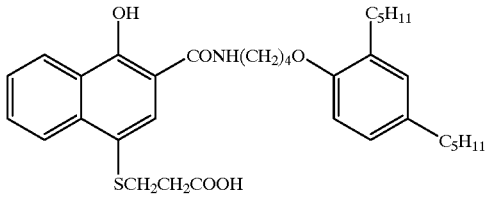

(I-2)

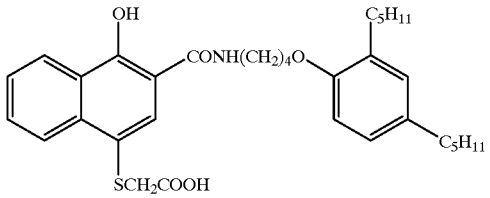

(I-3)

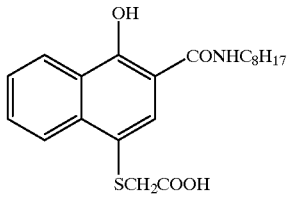

(I-4)

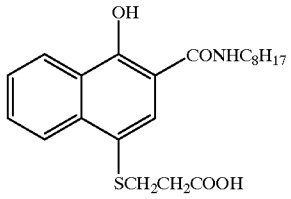

-continued
(I-5)
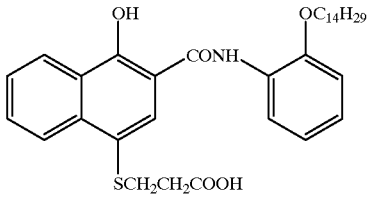
(I-6)
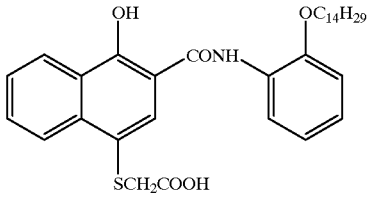
(I-7)
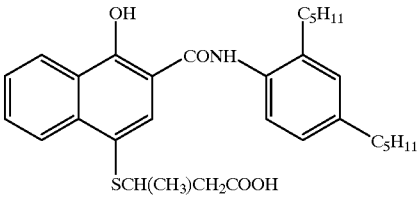
(I-8)
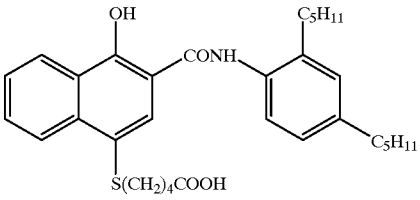
(I-9)
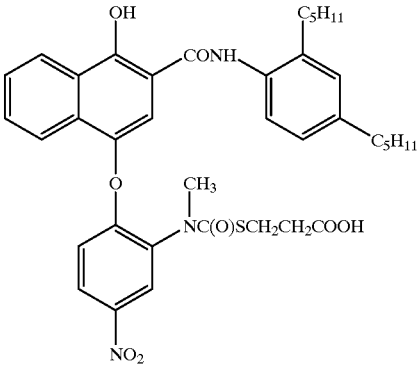
(I-10)
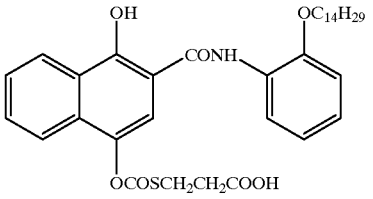
-continued
(I-11)
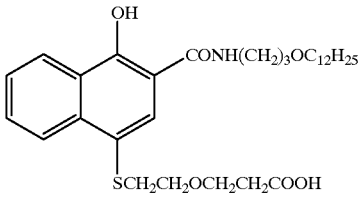
(I-12)
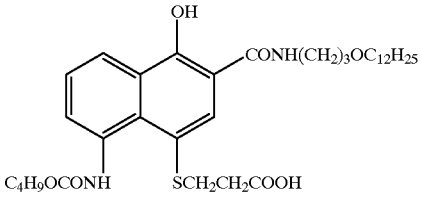
(I-13)
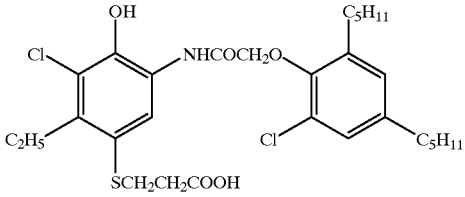
(I-14)
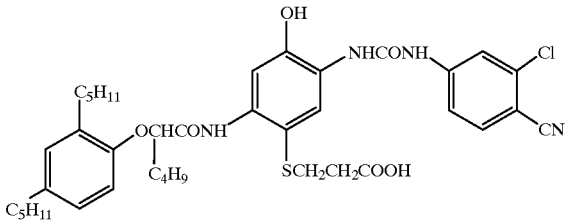
(I-15)
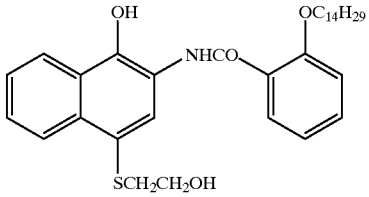
(I-16)
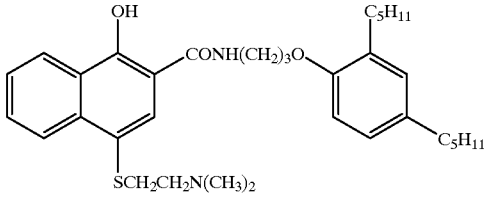
(I-17)
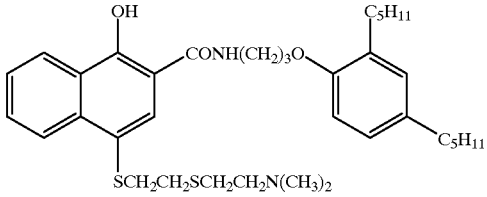

-continued (I-18)

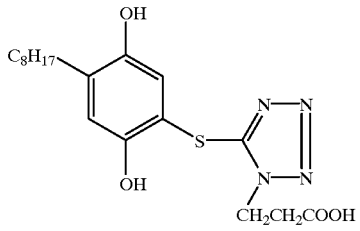

(I-19)

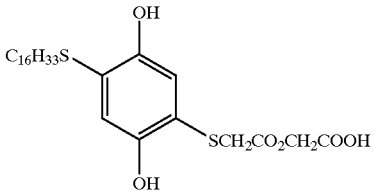

(I-20)

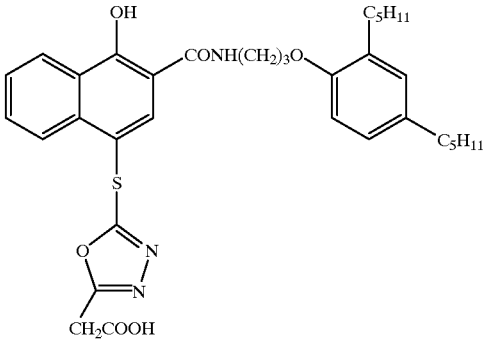

The SE cyan coupler is contained in the most sensitive red-sensitive silver halide emulsion layer. The amount of SE cyan coupler for use in this invention is from 0.005 to 0.100 g, and preferably from 0.010 to 0.050 g per square meter of the photographic element.

The core-shell silver bromoiodide tabular emulsion used in the present invention has a silver iodide content lower than 10%, preferably lower than 8% and an average diameter:thickness ratio (often referred to in the art as the aspect ratio) higher than 4.0, preferably higher than 5.0. Average diameters of the tabular silver bromoiodide grains suitable for use in this invention range from about 0.3 $\mu$m to about 5 $\mu$m, preferably 0.5 $\mu$m to 3 $\mu$m, more preferably 0.8 $\mu$m to 1.5 $\mu$m. The tabular silver bromoiodide grains suitable for use in this invention have a thickness of less than 0.4 $\mu$m, preferably less than 0.3 $\mu$m and more preferably less than 0.2 $\mu$m.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ as measured among the various methods.

In the silver halide emulsion layer containing tabular silver halide grains, at least 15%, preferably at least 25%, and, more preferably, at least 50% of the silver halide grains are tabular grains having an aspect ratio higher than 4.0. Each of the above proportions, "15%", "25%" and "50%" means the proportion of the total projected area of the tabular grains having an aspect ratio higher than 4.0, as compared to the projected area of all of the silver halide grains in the layer.

The core-shell silver bromoiodide tabular emulsion used in the present invention has a core shell structure comprising an inner core essentially consisting of pure bromide and a plurality of shells essentially consisting of silver bromide or silver bromoiodide.

The silver iodide content of each shell is in the range of from 0 to 40 mol %, preferably from 0 to 20 mol % relative to the total silver halide content of the shell. The plurality of shells preferably comprises at least two shells having different silver halide composition.

The minimal core-shell structure of the silver halide grains preferably consists in an inner core and two shells surrounding the inner core. The number of shells surrounding the inner core preferably ranges from two to four. Accordingly, the core-shell structure of the silver halide grains preferably consists in an inner core, an innermost shell adjacent the inner core, an outermost shell, and, optionally, one or more intermediate shells interposed between the innermost shell and the outermost shell. Preferably, the innermost shell adjacent to the inner core has a silver bromoiodide composition, with a silver iodide content of from 2 to 20 mol %, most preferably from 3 to 10 mol % relative to the total silver halide content of the shell, and the outermost shell has a silver bromide composition. The intermediate shells can have a silver bromide or silver bromoiodide composition, with a silver iodide content ranging from 0 to 40 mol %, preferably from 0 to 20 mol % relative to the total silver halide content of the shell.

The silver content of the core and the plurality of shells relative to the total silver content of the grain can have different values depending on the number of shells representing the plurality of shells. Preferably, the silver content of the inner core represents from 20 to 70 mol %, more preferably from 30 to 60 mol % relative to the total silver content of the grain. Preferably, the silver content of the plurality of shells represents from 30 to 80 mol %, more preferably from 40 to 70 mol % relative to the total silver content of the grain, Each shell can have a silver content ranging from 5 to 40 mol %, preferably from 10 to 25 mol % relative to the total silver content of the grain.

A pure silver iodide phase can be interposed between two adjacent shells. The pure silver iodide phase has a silver content of from 0.1 to 5 mol %, preferably from 1 to 3 mol % relative to the total silver content of the grain. At least one of the two adjacent shells surrounding the above mentioned pure silver iodide phase (that is, the two shells in contact with the pure silver iodide phase) has a silver iodide content higher than 5 mole %, preferably higher than 10 mole % relative to the total silver halide content of the shell.

The average iodide content of the silver halide emulsion grains according to the invention is lower than 10%, preferably lower than 8% relative to the total halide content of the emulsion grains.

The wording "essentially consisting of silver bromide or silver bromoioide" employed hereinabove in describing the core-shell emulsion according to the present invention means that the amount of halides different than iodide and bromide is less than 3 mole %.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, Dec. 1989, Item 308119 "Photographic Silver Halide Emulsions, Preparations, Addenda, Processing and Systems", and Research Disclosure, Sept. 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, and 1,302,405, U.S. Pat. Nos. 3,801,326, 4,046,376, 3,790,386, 3,897,935, 4,147,551, and 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, poly-acrylamide, etc. Other hydrophilic materials useful known in the art are described, for example, in Research Disclosure, Vol. 308, Item 308119, Section IX.

The silver halide grain emulsion can be chemically sensitized using sensitizing agents known in the art. Sulfur containing compounds, gold and noble metal compounds, and polyoxyalkylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonyl-acetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The Chemistry of Synthetic Dyes*, Academic Press, New York, 1971, Chapter V, James, *The Theory of the Photographic Process,* 4th Ed., Macmillan, !1977, Chapter 8, F. M. Hamer, *Cyanine Dyes and Related Compounds*, John Wiley and Sons, 1964, and in Research Disclosure 308119, Section III, 1989.

The silver halide emulsions can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

Silver halide multilayer color photographic elements according to the present invention comprise, coated on a support, a red-sensitive silver halide emulsion layer associated with cyan dye-forming color couplers, a green-sensitive silver halide emulsion layer associated with magenta dye-forming color couplers and a blue-sensitive silver halide emulsion layer associated with yellow dye-forming color couplers. Preferably, each red-, green- and blue-sensitive layer is usually comprised of multiple (two or more) emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in a layer arrangement comprising the red-sensitive layers coated nearest the support and overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an α-naphthol compound, is associated with red-sensitive silver halide emulsion layers; at least one non-diffusible magenta image-forming color coupler, such as a 5-pyrazolone type or a pyrazolotriazole type, is associated with green-sensitive silver halide emulsion layers and at least one non-diffusible yellow image forming color coupler, generally an acylacetanilide compound, is associated with blue-sensitive silver halide emulsion layers.

Color couplers may be 4-equivalent and/or 2-equivalent couplers, the latter requiring a smaller amount of silver halide for color production. As it is well known, as described above, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and α-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in GB 1,201,110, and in Research Disclosure 308119, Section VII, 1989.

The most useful magenta-forming couplers are conventional pyrazolone type, indazolone type, cyanoacetilic type, pyrazolotriazole type, etc., and particularly preferred couplers are the pyrazolone type compounds. Magenta forming couplers are described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; in Patent No. DE 1,810,464; in Patent Application Nos. DE 2,408,665, 2,417,945, 2,418,959 and 2,424,467; in Patent Application Nos. JP 20826/76, 58922/77, 129538/74, 74027/74, 159336/75, 42121/77, 60233/75, 26541/76 and 55122/78; and in Research Disclosure 308119, Section VII, 1989.

The most useful yellow-forming couplers are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE 2,219,917, 2,261,361 and 2,414,006, in GB 1,425,020, in JP 10,783/76, 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored color couplers which include those described for example in U.S. Pat. Nos. 3,476,560 and 3,034,892, in JP 2,016/69, 22,335/63, 11,304/67, 32,461/69, 26,034/76 and 42,121/77 and in DE 2,418,959 can be used. The light-sensitive silver halide color photographic element may contain high molecular weight color couplers as described for example in U.S. Pat. Nos. 4,080,211, in EP 27,284 and in DE 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, while the most useful colored magenta couplers are those exemplified above. Colorless couplers can be selected from those described in GB 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in US 4,366,237 and GB 2,125,570 and yellow, magenta and cyan couplers described in EP 96,873, in DE 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator, either directly or after removal of one or further groups from the group originally released. Examples of such 2-equivalent couplers include the known DIR couplers as well as DAR, FAR and BAR couplers. Typical examples of said couplers are described in DE 2,703,145, 2,855,697, 3,105,026, 3,319,428, 1,800,420, 2,015,867, 2,414,006, 2,842,063, 3,427,235, 3,209,110, and 1,547,640, in GB 953,454 and 1,591,641, in EP 89,843, 117,511, 118,087, and 301,477 and in Research Disclosure 308119, Section VII, 1989.

Examples of non-color forming DIR coupling compounds which can be used in silver halide color elements include those described in U.S. Pat. Nos. 3,938,996; 3,632,345, 3,639,417; 3,297,445 and 3,928,041; in German 2,405,442; 2,523,705; 2,460,202; 2,529,350 and 2,448,063; in Japanese 143,538/75 and 147,716/75, in GB 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE 853,512 and 869,816, in U.S. Pat. Nos. 4,214,047 and 4,199,363 and in EP 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylenediamine derivatives, widely employed in various color photographic process. Particularly useful color developing agents are the p-phenylendiamine derivatives, especially the N,N-dialkyl-p-phenylenediamine derivatives wherein the alkyl groups or the aromatic nucleus can be substituted or not substituted.

Examples of p-phenylenediamine developers include the salts of: N,N-diethyl-p-phenylenediamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfon-amido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.NH4, wherein EDTA is the ethylenediamino-tetracetic acid, or PDTA.Fe.NH4, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLES

A three layer monochrome sensitive to red light (Sample 101, comparison) was prepared having the layers of the following compositions coated on a transparent cellulose acetate film support having a gelatin subbing layer and an antihalo layer. In the following compositions, the coating amounts of silver halides, gelatin and other additives are reported in grams per square meter (g/m$^2$). All silver halide emulsions were stabilized with 4-hydroxy-6 methyl-1,3,3a, 7-tetrazaindene and spectrally sensitized with red sensitizing dyes S-1, S-2 and S-3.

| Layer 1 (Least Red-Sensitive Emulsion Layer) | |
|---|---|
| Silver lodobromide Emulsion 1a (AgI 3.0 mol %, average diameter 0.37 μm) | 0.420 |
| Silver lodobromide Emulsion 1b (AgI 60 mol %, average diameter 0.60 μm) | 0.420 |
| Gelatin | 1.370 |
| Cyan coupler C-1 | 0.369 |
| Cyan Masking Coupler CM-1 | 0.045 |
| Dye 1 | 0.028 |
| Dye 2 | 0.008 |
| Solv-1 | 0.210 |
| Solv-2 | 0.255 |

| Layer 2 (Mid Red-Sensitive Emulsion Layer) | |
|---|---|
| Silver lodobromide Emulsion 2 (AgI 6 mol %, average diameter 0.80 μm) | 0.980 |
| Gelatin | 1.280 |
| Cyan coupler C-1 | 0.416 |
| Cyan Masking Coupler CM-1 | 0.062 |
| Dye 2 | 0.010 |
| Solv-1 | 0.160 |
| Solv-2 | 0.301 |

| Layer 3 (Most Red-Sensitive Emulsion Layer) | |
|---|---|
| Silver lodobromide Emulsion 3 (Core-shell with iodide content in the core of 36 mol %, a total amount of 12 mol % of AgI, average diameter 1.35 μm, A/R 3.5) | 1.240 |
| Gelatin | 1.130 |
| Cyan Coupler C-1 | 0.232 |
| Cyan Masking Coupler CM-1 | 0.020 |
| Solv-1 | 0.080 |
| Solv-2 | 0.161 |

Samples 102 and 103 (comparison) were prepared as sample 101, but layer 3 contained 17.5 and 35 mg/m$^2$ of compound I-2, respectively.

Samples 201 to 203 (comparison) were prepared as samples 101 to 103, but the emulsion 3 of layer 3 was replaced by emulsion 4 (a core-shell silver bromoiodide emulsion containing a iodide content in the core of 36 mol %, a total content of 12 mol % of AgI, an average diameter of 1.00 μm and an A/R of 2.0).

Samples 301 (comparison) and samples 302 to 303 (invention) were prepared as samples 101 to 103, but the emulsion 3 of layer 3 was replaced by emulsion 5 (a core-shell silver bromoiodide emulsion containing a pure bromide core, a total content of 6 mol % of AgI, an average diameter of 1.55 μm and an A/R of 5.5).

Samples 101 to 103, 201 to 203 and 301 to 303 were exposed to a white light source having a color temperature of 5,500 Kelvin. All the exposed samples were developed in a standard type C41 process as described in British Journal of Photography, Jul. 12, 1974, pp. 597–598. The sensitometric results are showed in the following Table 1.

TABLE 1

| Samples | Emulsion in most red-sensitive layer | SE cyan coupler in most red-sensitive layer (mg/m$^2$) | Dmin | Dmax | Speed 0.2 | Speed 1.0 | Contrast |
|---|---|---|---|---|---|---|---|
| 101 (Comparison) | 3 | 0.0 | 0.52 | 3.10 | 2.69 | 1.94 | 1.05 |
| 102 (Comparison) | 3 | 17.5 | 0.71 | 2.53 | 2.07 | 1.25 | 0.87 |
| 103 (Comparison) | 3 | 35.0 | 0.54 | 3.01 | 2.51 | 1.80 | 1.11 |
| 201 (Comparison) | 4 | 0.0 | 0.54 | 3.14 | 2.60 | 1.92 | 1.13 |

TABLE 1-continued

| Samples | Emulsion in most red-sensitive layer | SE cyan coupler in most red-sensitive layer ($mg/m^2$) | Dmin | Dmax | Speed 0.2 | Speed 1.0 | Contrast |
|---|---|---|---|---|---|---|---|
| 202 (Comparison) | 4 | 17.5 | 0.60 | 3.09 | 2.44 | 1.78 | 1.18 |
| 203 (Comparison) | 4 | 35.0 | 0.87 | 2.96 | 2.33 | 1.59 | 0.92 |
| 301 (Comparison) | 5 | 0.0 | 0.43 | 3.10 | 2.63 | 1.97 | 1.21 |
| 302 (Invention) | 5 | 17.5 | 0.54 | 3.36 | 2.64 | 2.03 | 1.26 |
| 303 (Invention) | 5 | 35.0 | 0.56 | 3.55 | 2.72 | 2.19 | 1.28 |

The data of Table 1 clearly show the superior overall characteristics of the Samples 302 and 303 contemporaneously containing both the emulsion 5 and the compound I-2 in the most red-sensitive layer useful in the present invention. In fact, Samples 302 and 303 present an unforeseen enhancement in the values related to Dmax, speed and contrast, and a reduction in the tendence to fog formation compared with all the comparison samples.

Hereinbelow the formulas of the compounds employed in the examples are reported.

Red Sensitizer S-1

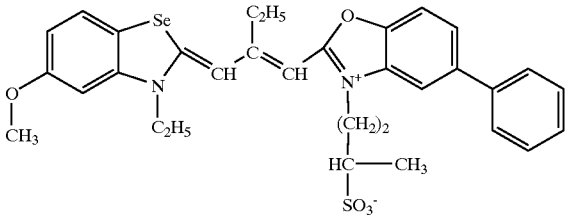

Red Sensitizer S-2

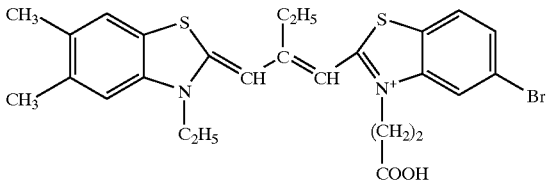

Red Sensitizer S-3

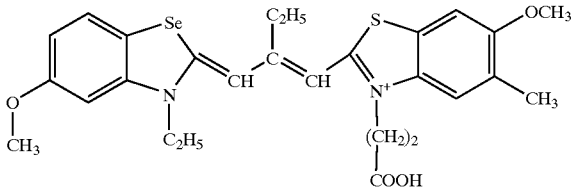

Cyan Coupler C-1:

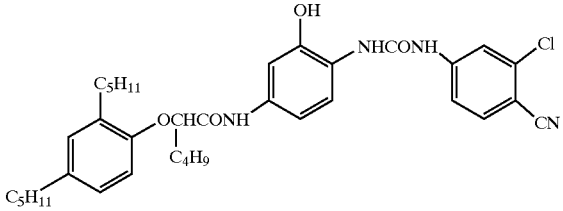

Cyan Masking Coupler CM-1:

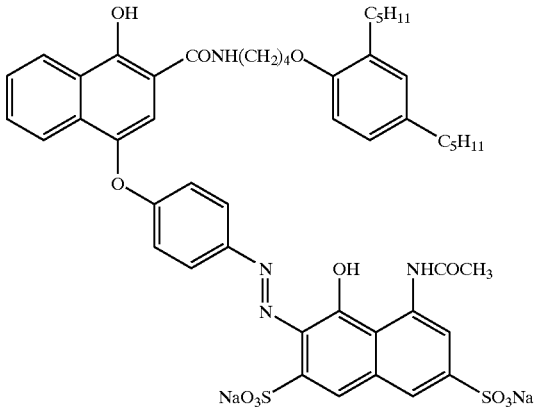

Dye 1:

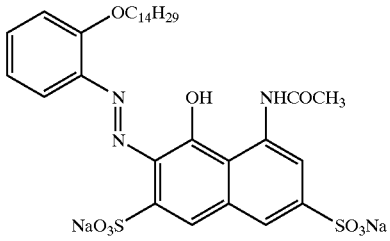

Dye 2:

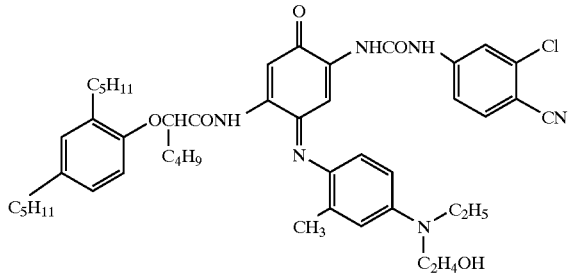

Solv-1:N-Butylacetanilide

Solv-2:Dibutylphthalate

What is claimed is:

1. A multilayer silver halide color photographic element comprising a support having coated thereon at least two red-sensitive silver halide emulsion layers having different sensitivity to red light, characterized in that the most sensitive of said red-sensitive silver halide emulsion layers comprises a core-shell silver bromoiodide tabular emulsion having a pure bromide core, a total silver iodide content lower than 10% and an aspect ratio higher than 5.0 and a Speed Enhancing (SE) cyan coupler represented by one of the following general formulas:

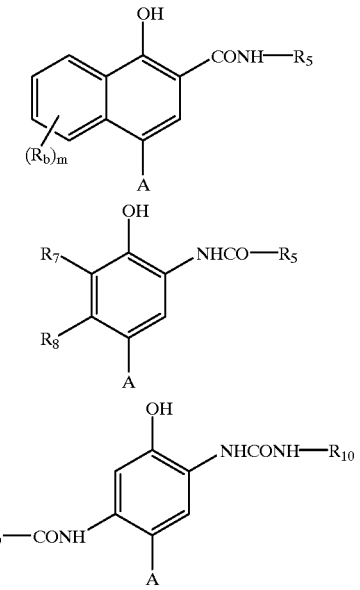

wherein A represents $(TIME)_n$—S—$R_1$—$R_2$, TIME is a timing group releasing S—$R_1$—$R_2$with delay under development conditions; n represents 0 or 1; $R_1$ is a divalent linking group, and $R_2$ represents a water-solubilizing group or —$NR_3$—$R_4$, wherein $R_3$ and $R_4$, which may be the same or different, each represents a hydrogen atom or an aliphatic group having from 1 to 3 carbon atoms; $R_5$ and $R_9$ represent a non-diffusible ballasting group, $R_6$ represents a group capable of substituting a hydrogen atom of the naphthol ring, m represents 0 to 3, $R_7$ represents hydrogen or a halogen atom, $R_8$ represents an alkyl group, and R10 represents an aryl group.

2. The multilayer silver halide color photographic element of claim 1, wherein the most sensitive of said red-sensitive silver halide emulsion layers comprises a core-shell silver bromoiodide tabular emulsion having a core shell structure comprising a pure bromide inner core and a plurality of shells consisting essentially of silver bromide or silver bromoiodide with a silver iodide content of each shell within the range of from 0 to 40 mol %.

3. The multilayer silver halide color photographic element of claim 2, wherein said silver iodide content of each shell is within the range of from 0 to 20% mol %.

4. The multilayer silver halide color photographic element of claim 1, wherein said the most sensitive silver halide emulsion layers comprises a SE cyan coupler having the following formula:

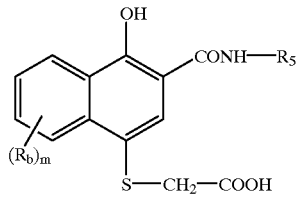

wherein $R_5$ represents a non-diffusible ballasting group $R_6$ represents a group capable of substituting a hydrogen atom of the naphthol ring and m represents 0 to 3.

5. The multilayer silver halide color photographic element of claim 1, wherein said the most sensitive of said red-sensitive silver halide emulsion layers comprises a SE cyan coupler having the following formula:

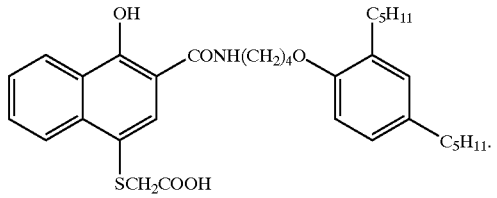

6. A multilayer silver halide color photographic element comprising a support having coated thereon at least two red-sensitive silver halide emulsion layers having different sensitivity to red light, characterized in that the most sensitive of said red-sensitive silver halide emulsion layers comprises a core-shell silver bromoiodide tabular emulsion having a pure bromide core, a total silver iodide content lower than 8% and an aspect ratio higher than 4.0 and a Speed Enhancing (SE) cyan coupler represented by one of the following general formulas

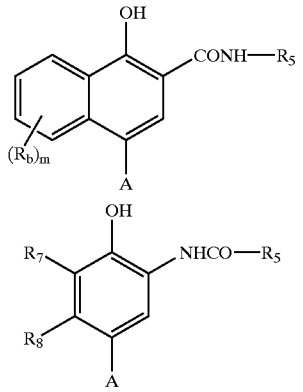

-continued

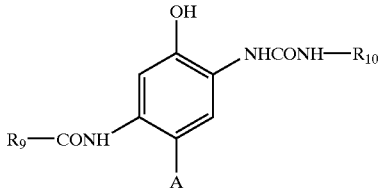

wherein A represents $(TIME)_n$—S—$R_1$—$R_2$, TIME is a timing group releasing S—$R_1$—$R_2$ with delay under development conditions; n represents 0 or 1; $R_1$ is a divalent linking group, and $R_2$ represents a water-solubilizing group or —$NR_3$—$R_4$, wherein $R_3$ and $R_4$, which may be the same or different, each represents a hydrogen atom or an aliphatic group having from 1 to 3 carbon atoms; $R_5$ and $R_9$ represent a non-diffusible ballasting group, $R_6$ represents a group capable of substituting a hydrogen atom of the naphthol ring, m represents 0 to 3, $R_7$ represents hydrogen or a halogen atom, $R_8$ represents an alkyl group, and R10 represents an aryl group.

* * * * *